US008099820B2

(12) United States Patent
Russell

(10) Patent No.: US 8,099,820 B2
(45) Date of Patent: Jan. 24, 2012

(54) TOOTHBRUSH

(75) Inventor: Bruce M. Russell, Howell, NJ (US)

(73) Assignee: Colgate-Palmolive Company, New York, NY (US)

( * ) Notice: Subject to any disclaimer, the term of this patent is extended or adjusted under 35 U.S.C. 154(b) by 130 days.

(21) Appl. No.: 12/361,989

(22) Filed: Jan. 29, 2009

(65) Prior Publication Data

US 2010/0192319 A1 Aug. 5, 2010

Related U.S. Application Data

(62) Division of application No. 10/665,799, filed on Sep. 18, 2003, now Pat. No. 7,503,092.

(60) Provisional application No. 60/412,186, filed on Sep. 20, 2002.

(51) Int. Cl.
*A46B 9/04* (2006.01)

(52) U.S. Cl. ..... 15/167.1

(58) Field of Classification Search ..... 15/167.1; 300/21

See application file for complete search history.

(56) References Cited

U.S. PATENT DOCUMENTS

| | | | | |
|---|---|---|---|---|
| D33,070 | S | 8/1900 | Hamilton | |
| 800,422 | A | 9/1905 | White | |
| 2,438,268 | A | 3/1948 | Bressler | |
| 4,132,449 | A | 1/1979 | Bergman | |
| 4,390,384 | A | 6/1983 | Turner | |
| 4,423,531 | A | 1/1984 | Wall | |
| 4,500,939 | A | 2/1985 | Gueret | |
| 4,592,594 | A | 6/1986 | d'Argembeau | |
| 4,762,373 | A | 8/1988 | Amos et al. | |
| 4,869,277 | A | 9/1989 | Olsen | |
| 4,979,782 | A | 12/1990 | Weihrauch | |
| 5,007,686 | A * | 4/1991 | Klein et al. | 300/21 |
| 5,044,041 | A | 9/1991 | Ljungberg | |
| 5,052,419 | A | 10/1991 | Olsen | |
| 5,143,425 | A | 9/1992 | Boucherie | |
| 5,306,143 | A | 4/1994 | Levy | |
| 5,327,611 | A | 7/1994 | Balster et al. | |
| 5,390,984 | A | 2/1995 | Boucherie et al. | |
| 5,407,254 | A | 4/1995 | Hegemann | |
| 5,472,263 | A | 12/1995 | Gerspacher | |
| 5,625,916 | A | 5/1997 | McDougall | |
| 5,673,454 | A | 10/1997 | Quintanilla et al. | |
| RE35,971 | E | 11/1998 | Kessler | |
| 5,836,036 | A | 11/1998 | Ivory | |
| 6,045,649 | A * | 4/2000 | Weihrauch | 156/272.8 |
| 6,088,870 | A | 7/2000 | Hohlbein | |
| 6,219,874 | B1 | 4/2001 | van Gelder et al. | |
| 6,779,851 | B2 * | 8/2004 | Bouchiere | 300/21 |
| 2001/0001887 | A1 | 5/2001 | Bigio | |

FOREIGN PATENT DOCUMENTS

| | | |
|---|---|---|
| EP | 0 124 937 | 11/1984 |
| EP | 0 150 785 | 8/1985 |
| WO | WO 97/30611 | 8/1997 |

* cited by examiner

*Primary Examiner* — Laura C Guidotti
(74) *Attorney, Agent, or Firm* — Judy W. Chung

(57) ABSTRACT

A toothbrush includes a handle and a head. The head is in the form of a peripheral frame having an open central area. A plurality of cleaning element carrying support members are mounted across the frame over the open central area to form an open lattice pattern having through holes to facilitate the cleaning of the head. The cleaning elements are bristles laser welded to the support members.

7 Claims, 3 Drawing Sheets

TOOTHBRUSH

RELATED APPLICATIONS

This is a divisional of application Ser. No. 10/665,799, filed Sep. 18, 2003 now U.S. Pat. No. 7,503,092, now allowed, which claims the benefit of the filing date of provisional application Ser. No. 60/412,186, filed Sep. 20, 2002.

BACKGROUND OF THE INVENTION

One of the complaints that consumers have regarding the brushing of teeth is the difficulty in washing away the residue of toothpaste and water left from a brushing and over time the ability to maintain a clean toothbrush. Part of the problem in washing away this residue is that the bristle carrier has been either a solid piece of plastic with blind holes or a solid piece of plastic in which bristles have either been embedded through a fusion process or through a molding process. In any case, it is quite likely that some of this residue will continue to reside on the bristle carrier around the bristles or bristle tufts as surface tension between the residue, and the material of the bristle carrier will cause residue to linger on the surface despite the user's best efforts.

U.S. Pat. No. 5,836,036 discloses a self-cleaning toothbrush wherein the head is provided with a series of intersecting support rails defining a grid pattern having the same thickness as the peripheral portion of the head. Open areas are created in the grid pattern which are overall greater than the corresponding bristle bunches to enhance the cleaning action when the head is placed under running tap water. The head including the grid pattern is of uniform thickness.

U.S. Pat. No. 6,088,870 shows a toothbrush with flexibly mounted bristles in a lattice or open network disposed against an otherwise imperforate base portion of the head. Thus, the head does not have through holes.

It would be desirable to provide a toothbrush which overcomes the problems relating to being able to maintain the toothbrush clean.

It would also be desirable if techniques could be used for effectively mounting the bristles to the carrier or head.

Various techniques have been disclosed in the prior art utilizing laser radiation and other techniques in the manufacture of toothbrushes. U.S. Pat. Nos. 4,592,594 and 4,762,373, for example, disclose rounding the bristle tips by the action of laser radiation. U.S. Pat. No. 5,306,143 discloses incorporating a laser device in the handle and a lens in the head as part of an optical system. Other patents disclosing various heat application techniques and related technology are U.S. Pat. Nos. 4,132,449, 4,390,384, 4,869,277, 4,979,782, 5,052,419, 5,390,984, 5,044,041, 5,143,425, 5,407,254, 5,472,263 and 5,673,454. In addition, reference is made to PCT/EP97/00825 (WO 97/30611), EP0124937 and EP0150785.

SUMMARY OF THE INVENTION

An object of this invention is to provide a toothbrush which minimizes problems relating to maintaining the toothbrush clean.

A further object of this invention is to provide techniques for mounting the bristles or other cleaning elements to the carrier or head of the toothbrush.

In accordance with this invention the head of the toothbrush includes a cleaning element carrier which is in the form of a peripheral frame having an open central area. The cleaning elements are secured to and extend outwardly from support members which are mounted to the frame at joints, such as slots or other openings in the frame. The support members extend across the open area of the frame in an open lattice type pattern having through holes over the open area to facilitate the cleaning of the toothbrush head.

The support members may be in the form of thin thermoplastic plates made from the same or similar material as the bristles. The bristles are secured to the plates by laser welding. This is accomplished by having a portion of the plate/bristle unit transparent to laser light wavelength while another portion is laser beam absorbing. The plates may then be secured at the joints on the frame in any suitable manner such as through a mechanical fit or through the use of various adhesives. A further manner of securement could be through welding including laser welding where the plates and frame are made of materials having similar melting temperatures.

In an alternative embodiment the support members could be base members made of the same material as the bristles such as a nylon material and could seat in arcuate openings at the joints on the frame when being stretched across the bristle carrier frame and thereby being attached on two sides.

In a preferred practice of this invention the cleaning elements are bristles which have their cleaning ends rounded.

THE DRAWINGS

DETAILED DESCRIPTION

Figure 1:
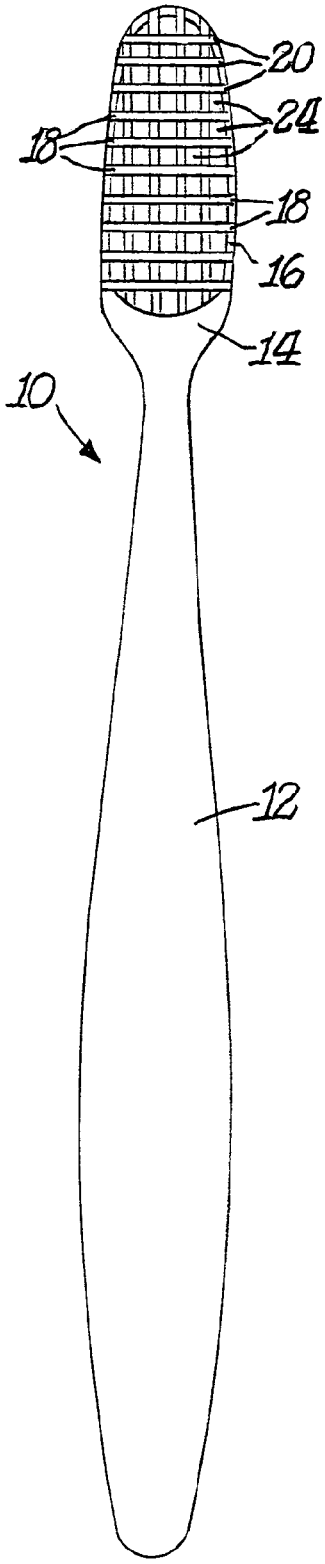
FIG. 1 is a front elevational view of a toothbrush formed in accordance with this invention.
Figure 5:
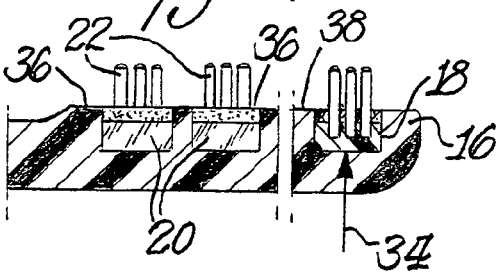
FIG. 5 is a cross-sectional view in elevation showing the plates of FIG. 3 or 4 mounted in the toothbrush of FIG. 1.

FIG. 1 illustrates a toothbrush 10 having a handle 12 and a head 14 mounted to one end of the handle. The head 14 includes a cleaning element carrier 16 in the form of a peripheral frame having an open central area. The frame may be an open ring, oval or other desired geometric shape including an irregular shape. The wall of the frame is provided with sets of joints 18 which could be in the form of slots, holes, pins or other types of joints. The joint could also be a raised portion such as a rib or ridge which fits into a corresponding complementary structure of the plates 20 which extend across the frame over the open central area. Similarly, the joint could simply be the contacting surfaces of the plates 20 with the frame 16. It is preferred that there be some seating of the plates into the frame to minimize any possibility of the plates being disconnected from the frame. As shown in FIG. 5 the joints 18 are in the form of holes or cavities exposed from the outer surface 38.

Figure 8:
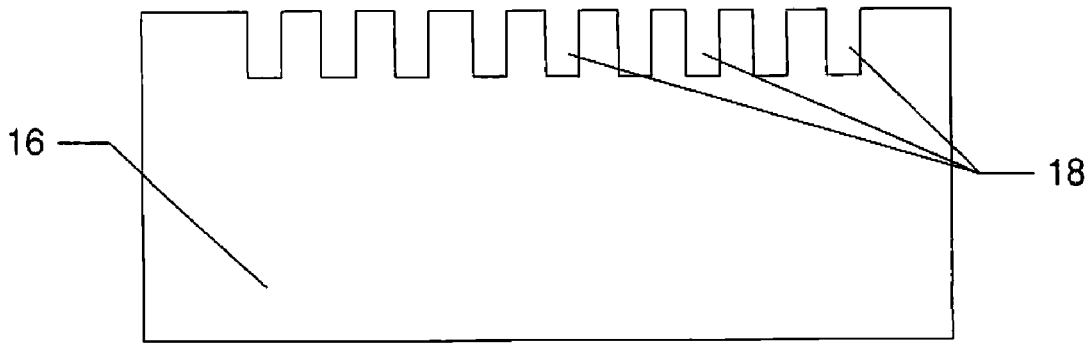
FIG. 8 illustrates one arrangement of the toothbrush head having slots formed in the frame for mounting the plates.

FIG. 8 illustrates one arrangement of the toothbrush head having slots formed in the frame for mounting the plates.

Plates 20 carry cleaning elements such as bristles 22, the illustration of which has been omitted from FIG. 1. As shown in FIG. 1 the plates 20 extend across frame 16 in an open lattice type arrangement or pattern having through holes 24. This will allow water, toothpaste and other materials that may commonly accumulate on the toothbrush head surface to be more easily rinsed away reducing the chances of bacteria forming and making for a more hygienic product. In addition, toothbrush 10 would be more economical due to the reduced material in the bristle carrier or head 14.

Although FIG. 1 illustrates the plates 20 to extend longitudinally and transversely across frame 16, any other open lattice pattern could be used. Such other patterns could include only longitudinal or only transverse plates or could include plates set obliquely across the open central area of frame 16. Similarly, while FIG. 1 shows the various longitudinal plates 20 to be parallel and equally spaced with respect to each other and shows the transverse plates 20 to be parallel and equally spaced with each other, different spacings or orientations could be used. The size of the through holes 24 would be dependent on the number of plates and their dimensions. A size should be selected sufficient to permit an effective residue cleaning of the head 14 and yet should include enough plates to provide sufficient cleaning elements on the plates.

Figure 2:
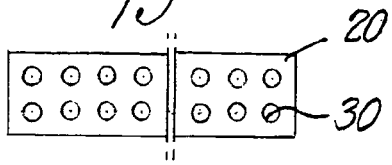
FIG. 2 is a front elevational view of a bristle carrying plate used in the toothbrush of FIG. 1.
Figure 3:
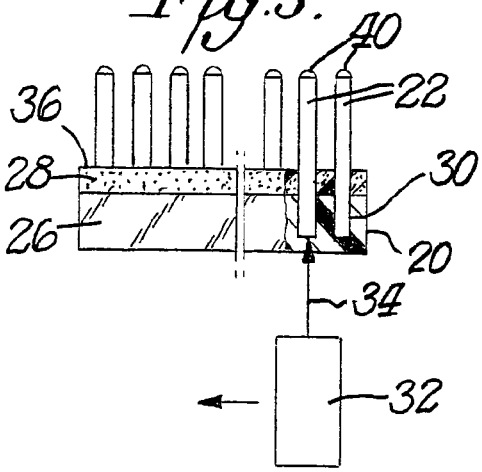
FIG. 3 is a side elevational view partly broken away showing the use of laser techniques for mounting the bristles to the plate of FIG. 2.

FIGS. 2-3 show a preferred method of mounting the bristles 22 to a plate 20. The materials used for plates 20 and bristles 22 would be such as to permit the use of laser welding. The toothbrush handle 12 and the frame or bristle carrier 16 could be manufactured by any conventional methods preferably injection molding where the handle 12 and frame 16 are integral with each other. The handle could be made of, for example, polyethylene, polypropylene, polyamide, polyester, cellulosics, SAN, acrylic, ABS or any other of the commonly known thermoplastics used in toothbrush manufacture. The head 14 could be made of the same material as the handle 12. If desired, the cleaning element carrier or frame 16 could be made of a separate material mounted against and joined to the portion of head 14 which is integral with handle 12.

The materials of the plate 20 and the bristle fibers could be made of any of the commonly known materials such as polypropylene, polyamide, polyester, etc. Preferably, plates 20 and bristles 22 are made from the same materials. Although the bristles 22 can be attached to the plate 20 by various means it is preferred to use laser welding for the attachment. In order to accomplish the laser welding, a portion of the plate/bristle unit must be transparent to the laser light wavelength while another portion must be laser beam absorbing. FIG. 3, for example, shows the plate 20 to have a portion 26 which is transparent to the laser light wavelength while another portion 28 is laser beam absorbing. Bristles 22 extend through absorbing portion 28.

As shown in FIGS. 2-3 the bristles 22 would be inserted into holes 30 in plate 20. An energy source 32 would apply laser beams 34 into the plate/bristle unit to effectively weld the bristles 22 to the plate 20. The energy source 32 would move across the plate 20 in the direction of the arrow for welding all of the bristles associated with plate 20 to the plate.

Figure 4:
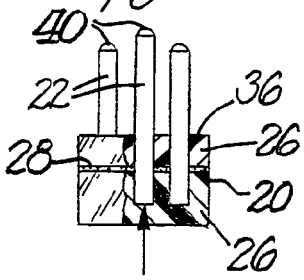
FIG. 4 is a side elevational view similar to FIG. 2 of an alternative technique.

FIG. 4 shows an alternative plate/bristle unit. As shown therein, the plate 20 has a pair of portions 26 which are transparent to the laser light wavelength while an absorbent layer 28 is provided at the weld interface. In both embodiments of FIGS. 3 and 4 the bristles 22 are also transparent to the laser light wavelength. The absorbent layer 28 could be applied as a colorant in the form of an ink pigment or any other dye type material.

Although FIGS. 2-4 show, for illustration purposes, the bristles 22 to be inserted into holes 30 in plate 20. Any suitable manner of disposing the bristles against the plate can be used as long as the attachment results such as through the use of laser welding. Thus, the bristles can be simply disposed against the outer surface 36 of the plate 20. Where laser welding is used what is important is that there should be combination of material transparent to laser light wavelength and material which is laser beam absorbing. Similarly, while FIGS. 3 and 4 illustrate specific locations for the laser beam absorbing material those locations are for illustration purposes only and any other location could be used including having the plate of one type of material (transparent or absorbing) with the fibers of the other type of material. Preferably, support plates 20 are thin, merely having sufficient thickness to provide a support member for the bristles. Similarly, the slots or openings 18 would be comparably thin so that a flush continuous outer surface results when plates 20 are secured to frame 16.

After the bristles 22 have been welded to plate 20 each plate 20 is then mounted to the frame 16 at two oppositely located joints so that the plate 20 spans across the frame 16 over the open central area.

FIG. 5 shows a series of plates 20 mounted to frame 16. This mounting could be accomplished in any suitable manner. One possible mounting is a mechanical fit for the joint similar to a tongue and groove or a dovetail or other types of commonly known mechanical joints. Preferably, the hole or cavity 18 is of a size so that plate 20 fits snugly into the hole 18 with the outer surface 36 of plate 20 flush or coplanar with the outer surface 38 of frame 16.

As shown in FIG. 1 the transverse plates 20 would span across frame 16 over the longitudinal plates 20. If desired, the longitudinal plates could be disposed over the transverse plates or the sets of plates could be mounted in a woven manner. The underlying plate at the areas of intersection would preferably have no bristles so as not to interfere with the mounting of the overlying plate.

The lattice pattern created by the cleaning element support members results in the open area of the frame being covered by spaced support members having cleaning elements such as bristles extending along the length of the support members. Such an arrangement of cleaning elements would be the same as would result where a toothbrush head is made in a conventional manner with cleaning elements such as bristles located throughout the outer surface of the head.

In addition to or instead of a pure mechanical fits the plates 20 could be mounted to frame 16 by any suitable adhesive. Other forms of mounting could be through various plastic welding techniques such as ultrasonics, induction welding, orbital friction welding, hot wire welding, etc. In the preferred practice of this invention plates 20 are made from the same material as bristle carrier or frame 16 or of a material with similar melting temperatures. As a result, the attachment of plate 20 to frame 16 could be done by laser welding. FIG. 5, for example, shows the laser beam 34 directed through frame 16. As with the mounting discussed in FIGS. 3-4 one of the items of the plate/frame unit should be transparent to laser light wavelength and the other should absorb laser beam energy. Similarly, a laser absorbing layer could be applied to one or both items at the weld interface as another means of accomplishing the joining of these items. In the preferred practice of the invention all of the laser beam welding would use a source 32 which is a ND:YAG laser, a CO2 laser and excimer laser or a diode laser, as well as other light sources, soft beam, optical light heating system or through quartz halogen lamps. The preferred method is to use a ND:YAG laser with a continuous wave as opposed to an Nd:YAG laser with a pulsed wave.

FIGS. 3 and 4 illustrate another aspect of this invention wherein the bristle ends 40 are rounded in order to avoid a user inadvertently causing damage to the gums during the brushing process. In this manufacturing method the bristles 22 can have their cleaning ends 40 rounded prior to attachment to the base plate 20 or to the bristle carrier 16; or the cleaning ends 40 can be rounded or deburred after the bristles have been attached to the plate 20 or to the bristle carrier 16.

It is also possible through the use of the bristle mounting techniques described herein to make a profile of the bristles. FIG. 4, for example, shows a set of bristles of differing length. This can be done by attaching different length bristles to the weld plate 20 to get the desired profile. Alternatively, different length bristles could be attached to the later described base string shown in FIG. 6. In addition, bristles made by this process can be profiled by cutting the completed bristle ends with profile trimmers as is currently done with stapled set toothbrushes.

Figure 6:
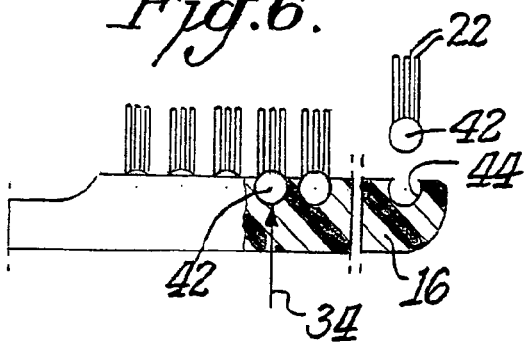
FIG. 6 is a side elevational view of an alternative form of bristle mounting in accordance with this invention.

FIG. 6 shows an alternative manner of forming the bristle supporting members. As shown therein the material for bristles 22 could be strands that have been attached to a base member 42. Materials, such as nylon (polyamide), are sometimes supplied in a form where strands are attached to a base member. The base member would be a string or spine and would be stretched across the carrier frame to fit in an opening 44 of arcuate shape to complement the cross-sectional area shape of base member 42. Base member 42 could be attached into opening 44 of frame 16 in any of the manners previously described with respect to plate 20. Preferably, frame 16 is made of the same material as base member 40 and bristles 22 so that a welding attachment could be used which is preferably a laser welding including Nd:YAG laser welding.

If desired, one or more base members or strings 42 with their bristles 22 could be mounted to a plate 20 and then secured to frame 16. The mounting of base string 42 to plate 20 could be in any suitable manner, such as by laser welding.

Although the preferred practice of this invention involves creating a lattice type pattern across the open central area of the frame, the features regarding the manner of mounting the bristles to the plate also represent an important aspect of this invention. Such features could be utilized where the head 14 does not include an open frame as the cleaning element carrier. Instead the entire head could be generally without any through holes and one or more plates could be utilized, as discussed above, wherein the laser welding techniques would be used to mount the bristles to the plate and then the plate would be mounted to the head. In the preferred practice of this aspect of the invention the bristles and the plate and the head would be made of the same material.

Although FIG. 1 illustrates a manually operated toothbrush, the invention may also be practiced where the head includes one or more power or electrically operated movable sections carrying cleaning elements. Such movable section may oscillate in a rotational manner or may oscillate linearly in a longitudinal direction with respect to the longitudinal axis of the head or may oscillate linearly in a lateral or transverse direction with respect to the longitudinal axis of the head. The movable section may oscillate in and out in a direction toward and away from the outer surface of the head. The movable section may rock back and forth with respect to the outer surface of the head. The movable section may rotate continuously in the same direction, rather than oscillate. Any suitable drive mechanism may be used for imparting the desired motion to the movable section. Where plural movable sections are used, all of the movable sections may have the same type and direction of movement, or combinations of different movements may be used.

Figure 7:
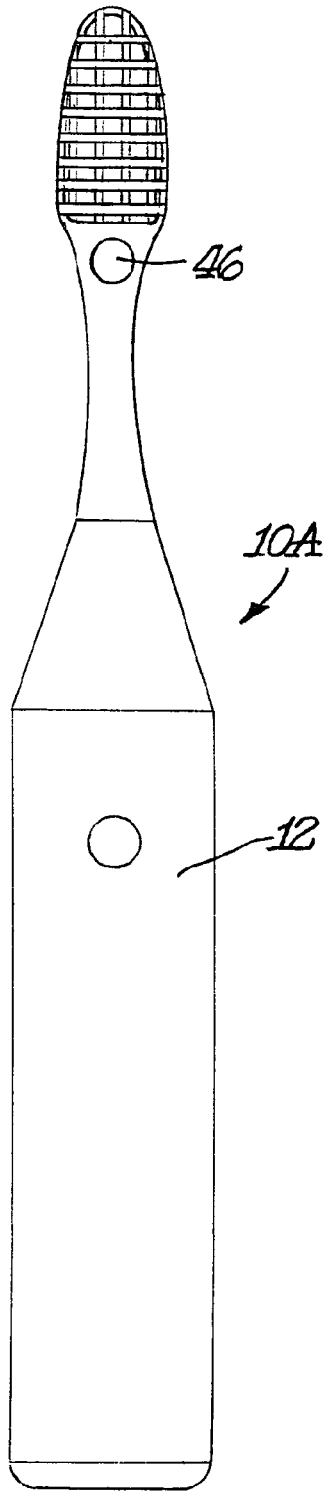
FIG. 7 is a front elevational view of a modified toothbrush in accordance with this invention.

FIG. 7 illustrates a toothbrush 10A which includes a power driven movable disc or section 46 having cleaning elements (not shown). The movable section 46 could be oscillated rotationally such as by using the type of drive mechanism shown in U.S. Pat. No. 5,625,916, or could move in and out using the type of drive mechanism shown in U.S. Pat. No. Re35,941, all of the details of both patents are incorporated herein by reference thereto. Alternatively, the other types of drives referred to above could move section 46 in other manners and directions. Although FIG. 7 shows movable section 46 to be adjacent the handle 12, the movable section(s) could be located at any desired location on the head by suitable modification to accommodate the movable section.

In the preferred practice of this invention the cleaning elements are bristles as previously described. The invention, however, could be practiced broadly where the term "cleaning elements" is used in a generic sense which could include fiber bristles or massage elements or other forms of cleaning elements such as elastomeric fingers or walls arranged in a circular cross-sectional shape or any other type of desired shape including straight portions or sinusoidal portions. Different portions of head 14 could include different cleaning elements. Similarly, the movable disc 46 could include cleaning elements which differ from the cleaning elements used in other parts of the head. The cleaning elements could extend outwardly from the head, generally perpendicularly from the outer surface or could be disposed at various angles to the head. Thus, it is possible to select the combination of cleaning element configurations, materials and orientations to achieve intended results to deliver additional oral health benefits, like enhanced cleaning tooth polishing, tooth whitening and/or massaging of the gums.

As best seen in FIGS. 5 and 6, the head 14 has a structure wherein the frame 16 has thin plates 20 or base support members 42 across its outer surface 38 but wherein the frame 16 or head 10 is totally open inwardly of or below the cleaning element support members 20, 42.

By having the cleaning element support members 20, 42 such as the plates 20 and base members 42 generally thin and mounted across the outer surface 38 of the frame 16 less material is used than if, for example, the cleaning element support members 20,42, were made integral with and of the same thickness as the frame 16. In addition, because the peripheral wall of the frame 16 extends inwardly from the cleaning element support members 20, 42, the toothpaste or other residue is more readily cleaned since it need be removed only a short distance which is the thickness of the cleaning element support members 20, 42 rather than the entire thickness of the peripheral wall of the frame 16.

What is claimed is:

1. A toothbrush comprising:

a handle;

a head mounted to one end of said handle, said head including a cleaning element carrier;

at least one cleaning element support plate, a plurality of bristles mounted to and extending outwardly from said plate, said bristles and said plate being made of thermoplastic material having similar melting temperatures, said bristles and said plate forming a unit; and a first layer of said plate being laser beam transparent and a second layer of said plate being laser beam absorbent, said bristles being secured to said plate by laser welding, and said plate being mounted to said carrier.

2. The toothbrush of claim 1 wherein said carrier is made of a material having a similar melting temperature to said unit, and said unit being laser welded to said carrier.

3. The toothbrush of claim 1 wherein said carrier includes a slot, and said unit being mounted in said slot.

4. The toothbrush of claim 3 wherein the cleaning ends of said bristles are rounded.

5. The toothbrush of claim 1 wherein the bristles extend through the second layer of the plate.

6. The toothbrush of claim 1 wherein the plate further comprises a third layer that is laser beam transparent, the second layer of the plate being disposed between the first and third layers of the plate.

7. The toothbrush of claim 6 wherein the bristles extend through the second layer of the plate.

* * * * *